United States Patent [19]

Dysthe

[11] 4,343,486

[45] Aug. 10, 1982

[54] SKI BINDING

[76] Inventor: Sven I. Dysthe, Gamle Rykkinn vei 38, N-1349 Rykkinn, Norway

[21] Appl. No.: 135,658

[22] Filed: Jun. 17, 1980

[51] Int. Cl.[3] ..... A63C 9/00

[52] U.S. Cl. ..... 280/615; 280/625

[58] Field of Search ..... 280/615, 623, 625, 631, 280/632

[56] References Cited

U.S. PATENT DOCUMENTS

| | | | |
|---|---|---|---|
| 2,246,153 | 6/1941 | Wallace | 280/614 |
| 2,758,846 | 8/1956 | Swenson | 280/614 |
| 4,231,585 | 11/1980 | Riikonen | 280/615 |

FOREIGN PATENT DOCUMENTS

| | | | |
|---|---|---|---|
| 105019 | 6/1924 | Switzerland | 280/615 |

*Primary Examiner*—Joseph F. Peters, Jr.
*Assistant Examiner*—Donald W. Underwood
*Attorney, Agent, or Firm*—Watson, Cole, Grindle & Watson

[57] ABSTRACT

A ski binding which includes a keeper element and a clamping mechanism for retaining a ski boot therein, the clamping mechanism including a U-shaped fixing strap arranged in guides on the keeper element with upwardly extending free ends for coaction with holes in the front sole portion of a ski boot, and a tensioning device which connects with a transverse portion of the fixing strap in such a manner that the free ends of the strap, upon operation of the clamping device, will pull the ski boot forwardly in the longitudinal direction of the ski and into the keeper element. The tensioning device incorporates a intermediate piece, which is preferably adjustable in length, and a tensioning arm, the intermediate piece being rotatably connected to the tensioning arm at one end and to the transverse portion of the fixing strap at its other (front) end. The binding may be released by causing the front end of the intermediate piece to be lifted upwardly with respect to the top surface of the ski.

5 Claims, 7 Drawing Figures

SKI BINDING

BACKGROUND OF THE INVENTION

The present invention relates to a ski binding for use in racing and cross country skiing. More specifically, the invention relates to a ski binding with a keeper element-a clamping mechanism for pulling a ski boot into the keeper element and for retaining it therein.

Modern ski boot sole standards for lighter weight ski boots have created a number of problems, especially in the case of boots of the 50 mm "Nordic Racing Norm" type. This latter boot standard implies a very small ski binding with small contact faces for the boot, and such a binding must be constructed to operate with very small tolerances. Known bindings attempt to satisfy these tolerance requirements by utilizing a substantially plow-shaped keeper element into which the boot is pushed or pulled. This type of binding has the advantage that wear on the front sole portion and on the vertical contact faces of the binding is compensated for by pulling the boot into the binding.

In Norwegian Pat. No. 132.576 there is disclosed a ski binding in which two pins are fixed relative to the longitudinal direction of the ski, are also movable in a vertical direction through a tiltable mounting about a mounting point.

In Norwegian Pat. No. 47.867 a ski boot is pulled into a ski binding either by a hook connected to the frontmost end of the boot or by a device attached to the heel.

Norwegian Pat. No. 107.796 shows a ski binding which is to some extent comparable with what is shown in Norwegian Pat. No. 47.867. A bracket is attached to the boot and a clamping device can, by an adjustable intermediate piece, be brought into engagement with a hook on the bracket, so that the boot may be pulled into and retained in the ski binding. However, it is not advantageous to have such brackets on boots, both because these increase the cost of the boot itself and because bindings consisting of several separate parts require a very accurate, and thus time consuming, installation.

Norwegian Pat. No. 78.1181 relates to a ski binding intended for slalom and down hill racing with a mechanism for releasable blocking of the swing action of the boot heel up from the ski by a rigid, possibly somewhat resilient, arm or plate extending in a rearward direction relative to the keeper element and intended to enter into a channel, an indentation or the like in the heel portion of the boot to thereby cause locking of the heel to the ski. The arm or plate is formed by an extension of the bottom plate of the keeper element or is fixedly attached to the keeper element or the upper face of the ski.

Norwegian Pat. No. 47.051 relates to a ski binding without any rear strap, comprising tabs known per se with inwardly directed projections bearing against the upper edge of the sole. A plate known per se and shiftable in the direction of the ski has on its upper face suitable elements (e.g. spikes) which can be brought into engagement with the lower side of the sole, blocking devices being arranged to prevent the plate when moved between the tabs to be pulled out again, so that the boot, when arranged on the plate and moved therewith in between, will be firmly locked to the ski in coaction with (a) the devices on the upper side of the shiftable plate, (b) the blocking device, and (c) the inwardly bent projections on the tabs. Thus the boot is moved in the longitudinal direction of the ski during the clamping process. The clamping itself is provided by a resilient plate upon which a knob is placed and which is coactable with holes in the plate. If the boot should be of a form to most suitably be clamped by hole number two of the holes, it may so happen that this is not possible and that clamping therefore must take place by the first hole, whereby the risk is that the boot will not fit properly in the binding. The solution is therefore not particularly advantageous in practice.

Norwegian Pat. No. 63.959 relates to a binding consisting of two separate and on-screwable parts, one part consisting of a clamping device with an adjustable intermediate piece and a rear strap loop intended to grip about the heel of the boot.

Norwegian Pat. No. 84.786 relates to a pretensioner for a ski binding where a tensioning device fixed to the ski is connected with the front end of a helical spring, the other end of which for regulation purposes is in threaded engagement with a screw spindle connected to the rear strap. The screw spindle extends through the mechanism supporting the front portion of the straps, and on the rear side thereof is provided with a service button for regulation of the connection and the tensioning is transferred to the rear strap. It is here the case of two separate main parts.

In Norwegian Pat. No. 130.563 there are fixed pins which are brought in engagement with corresponding holes in the toe part of the boot and where a strap may be clamped by way of a clamp over the top of the front sole edge, thus keeping the boot retained in the keeping element of the binding.

The present invention has an object to provide a ski binding which overcomes the many disadvantages of the known bindings and which is simple and cheap to manufacture and advantageous upon installation on the ski.

SUMMARY OF THE INVENTION

The ski binding according to the invention is characterized in that it includes a keeper element and a clamping mechanism comprising (a) a preferably U-shaped fixing strap arranged to slide in guides on the keeper element and including a transverse portion and free upwardly extending portions which are coactable with holes in the front sole portion of the boot, and (b) a tensioning mechanism that is rotatably connected to the transverse portion of the fixing strap, the tensioning mechanism including a tensioning arm which, when moved, will cause the U-shaped fixing strap to slide forwardly in the longitudinal direction of the ski and cause the ski boot placed thereon to slide into the keeper element of the binding.

According to a further feature of the inventive ski binding, the tensioning mechanism will include an intermediate piece, one end of which will be snap fitted to the transverse portion of the fixing strap and the other end of which will be hinged to a middle portion of the tensioning arm, whereas one end of the tensioning arm will be hinge-connected to the front, preferably upper, portion of the keeper element and the other end of which will be manually operable such that upon depression the fixing strap will be caused to move.

According to another feature of the invention, the intermediate piece may consist of two interconnected parts, one part being screw shaped and threaded into a second part which is threaded internally, such that they can be adjusted with respect to one another to change the overall length of the intermediate piece.

According to another feature of the invention, the forwardly directed end portion of the intermediate piece is preferably shaped to form contact face for an acting device, e.g., a ski pole point, the binding being releasable by depression of the end portion when it tilts about a portion raised above the top surface of the ski.

According to still another feature of the present invention, the fixing strap encompasses substantially most of the clamping device.

The invention will now be better understood by reference to the accompanying drawings taken in conjunction with the following discussion;

DETAILED DESCRIPTION OF THE PREFERRED EMBODIMENTS

Figure 1:
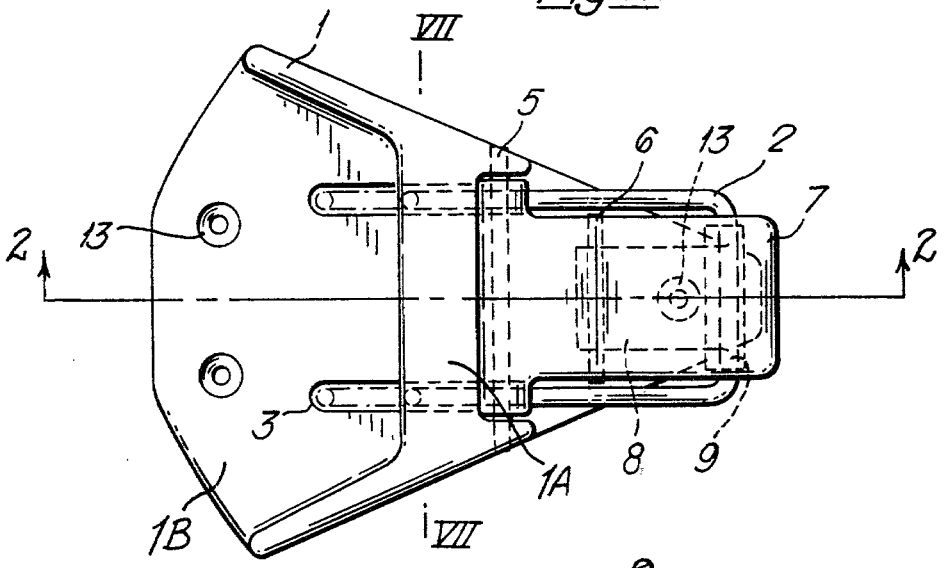
FIG. 1 shows a plan view of a first embodiment of ski binding constructed according to the invention.

As shown in FIG. 1, the inventive ski binding includes a plow-shaped keeper element 1 (known per se) for the front sole portion of the ski boot (not shown). The keeper element includes a bridge portion 1A and base portion 1B which is provided with grooves or recesses 3 for providing free passage for a movable, substantially U-shaped strap 2 of, e.g., metal wire, which has at one end a transverse portion 9 and at its opposite end upwardly protruding end portions 4. These end portions 4 are intended to be coactable with holes in the front sole portion of a ski boot, which holes may be arranged in accordance with accepted standards.

The U-shaped strap 2 is freely movable in the longitudinal direction of the ski and may thereby, together with the boot, be pulled forwardly and into the bridge portion 1A of the keeper element 1. The advantage of using a strap with the noted configuration is based both on productional reasons and use. With regard to production, the number of parts are reduced because the upwardly projecting end portions 4 coact with the boot. With regard to use, the free movement of the strap in the spacy grooves or recesses 3 is advantageous because the movability of the strap is not stopped by collection of snow or formation of ice, a problem that may be encountered with some of the known ski bindings.

Figure 2:
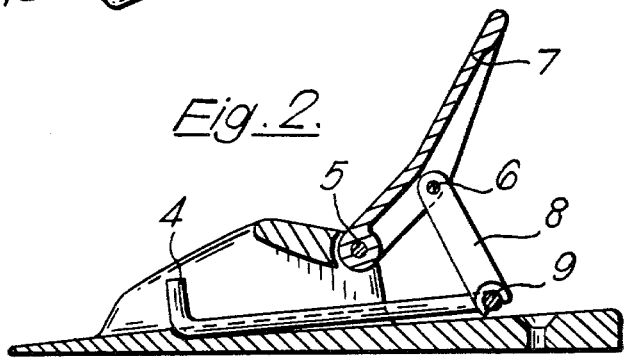
FIG. 2 shows a sectional view of the ski binding of FIG. 1 as seen along line 2—2.
Figure 3:
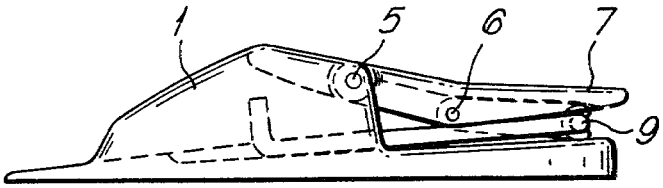
FIG. 3 is a side view of the ski binding shown in FIG. 1.

As illustrated in FIGS. 1–3 the binding includes a tensioning mechanism 7, 8 consisting of a tensioning arm 7 which is T-shaped and an intermediate piece 8. One end, i.e., the head portion of the tensioning arm 7 is connected to hinge rod 5 which is itself connected at its ends to the bridge portion 1A of the keeper element 1. The opposite (free) end, i.e., the base portion of the tensioning arm 7 is intended for manual handling, i.e., to move the arm 7 around hinge rod 5 when desired. One end of the intermediate piece 8 is connected to hinge rod 6 which is itself connected to the tensioning arm 7 at about halfway along its length, the other end of the intermediate piece 8 being snapped onto the transverse portion 9 of the strap 2. Upon depression of the tensioning arm 7 such that the arm 7 rotates about hinge rod 5, the upwardly extending ends 4 of the strap will be pulled into the keeper element 1 together with the boot. At the lower position of the tensioning arm 7 (see FIG. 3), the hinge rod 6 forms a dead point so that the movement of the tensioning device in this position is locked.

The base portion 1B of the keeper element 1 includes holes 13 for attaching the binding to the ski (not shown) by means of screws (not shown). Three holes will normally be sufficient for the installation.

Figure 4:
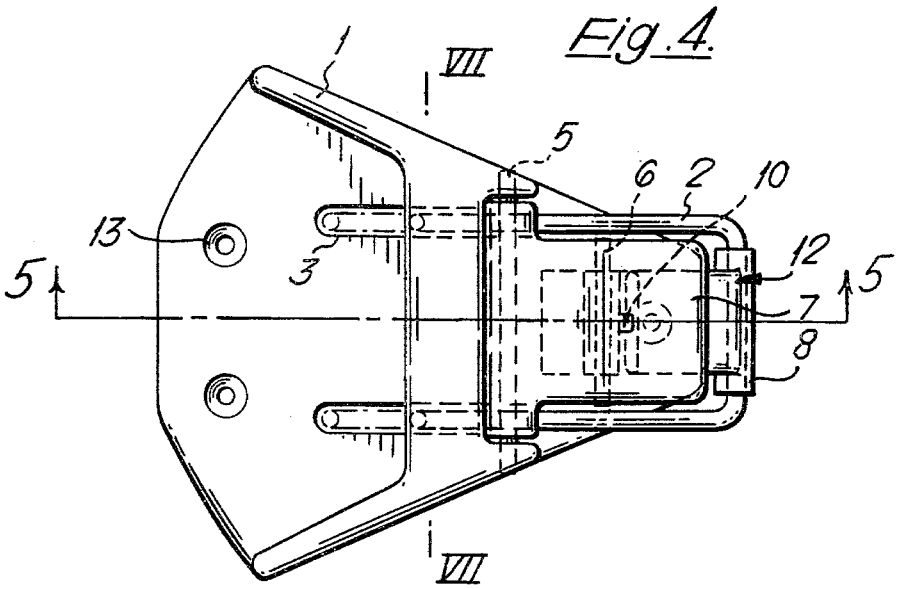
FIG. 4 shows a plan view of a second embodiment of ski binding constructed according to the invention.
Figure 5:
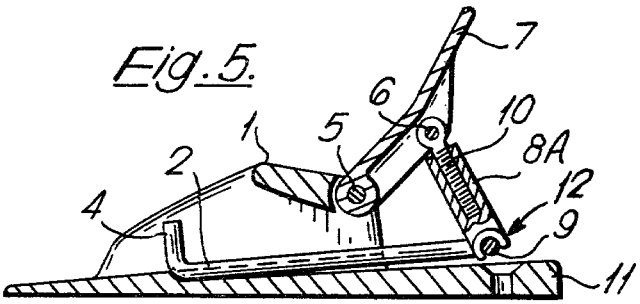
FIG. 5 shows a sectional view of the ski binding of FIG. 4 as seen along line 5—5.
Figure 6:
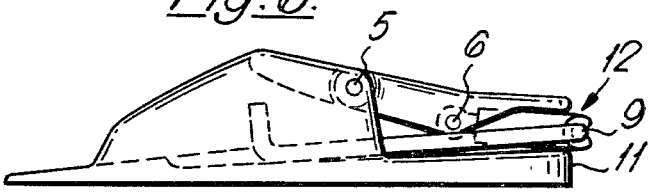
FIG. 6 shows a side view of the binding in FIG. 4.
Figure 7:
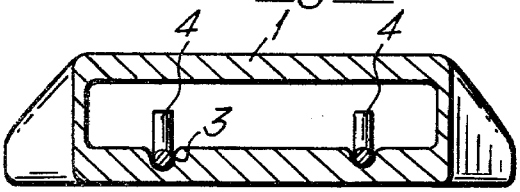
FIG. 7 shows a cross sectional view of the ski binding shown in FIGS. 1 and 4 as seen along lines VII—VII.

In FIGS. 4 to 6, which show a second embodiment of the invention wherein the tensioning mechanism is adjustable, the intermediate piece 8 comprises a socket element 8A and a threaded bolt 10, the socket element being provided with a threaded longitudinal hole for introduction of the threaded bolt 10. One end of the threaded bolt is connected via an eye to hinge rod 6. If the socket element 8A is made of, e.g., plastic, the bolt 10 itself may, upon entry therein, create the necessary internal threads in the socket element 8A that the use of expensive tools for casting the required threads (or the making of the threads through machining) in the socket element will be unnecessary. However it may still be suitable to make the length-adjustable intermediate piece from, e.g., brass or other suitable metal.

Concerning the present invention, although prior art ski bindings are known wherein the clamping mechanism will be locked through a dead point, these bindings act differently from the present one: in the present ski binding the strap coacts with the other structure in a new fashion and the components are subjected to compression instead of tensioning. The ski binding can therefore be constructed with a slimmer dimensioning than for the known ski bindings and thereby will be lighter in weight. It is, however, important to also note that by turning the construction one obtains an intermediate piece 8 at the front in such a manner that the binding may be released by a ski pole pin. In this regard, the wide end portion 12 of the socket element 8A which is in snap engagement with the strap branch 9 will extend beyond the front portion 11 of the base portion of the keeper element; thus when the end portion 12 is acted upon by the ski pole pin, the hinged point 6 will be brought above the dead point such that the binding is released. There is thus provided a ski binding which is more compact in that the tensioning mechanism lays within the contour of the strap. The keeper element 1 and the tensioning arm 7 are preferably made from a suitable plastic material. The intermediate piece 8 with its integral end piece 12 may be made from, e.g., reinforced plastic material or a metal. Thus, there is provided a binding which is small and light and which represents substantial technical advantages relative to the prior art bindings.

I claim:

1. A ski binding which comprises a keeper element which includes a base portion and a bridge portion, said base portion including two spaced-apart grooves therein extending below said bridge portion, and a clamping mechanism for pulling and retaining a ski boot within said bridge portion of said keeper element, said clamping mechanism including a generally U-shaped fixing strap which has two legs, a transverse portion connecting corresponding ends of said two legs, the opposite corresponding ends of said two legs having upwardly extending end portions intended to fit within said grooves in said keeper element base portion, and a tensioning device for moving said U-shaped fixing strap such that it will slide in said grooves from a position wherein the upwardly extending end portions thereof are outside said bridge portion of said keeper element to a position wherein the upwardly extending ends thereof are within said bridge portion of said keeper element, said tensioning device including a tension arm rotatably connected to the bridge portion of said keeper element and an intermediate piece, the first end of the intermediate piece being rotatably connected to said tension arm at about halfway along the length of the tension arm to form a hinge joint and the second end of the intermediate piece being C-shaped and rotatably snap fitted onto said transverse portion of said U-shaped fixing strap, said tension arm and said intermediate piece being operable such that when said tension arm is rotated towards said base portion of said keeper element, said hinge joint will move downwardly to a dead point.

2. The ski binding of claim 1, wherein the intermediate piece is composed of two parts which are adjustable with respect to one another to change the overall length of the intermediate piece.

3. The ski binding of claim 1, wherein the intermediate piece has a sufficient length that the second end thereof connected to the transverse portion of said U-shaped fixing strap can extend beyond the end of the base portion of the keeper element, thus, when desired, allowing the intermediate piece to be activated by a ski pole pin so as to lift said hinge joint upwardly and away from said dead point.

4. The ski binding of claim 1, wherein said tensioning arm is generally T-shaped, the head portion being the end of said tensioning arm which is rotatably connected to said keeper element.

5. The ski binding of claim 4, wherein the base portion of said T-shaped tensioning arm and said intermediate piece have a lesser width than the width of said generally U-shaped fixing strap.

* * * * *